United States Patent [19]

Markison

[11] Patent Number: 4,785,755

[45] Date of Patent: Nov. 22, 1988

[54] SAIL BOARD HANDGRIP

[76] Inventor: Robert E. Markison, 464 Alvarado St., San Francisco, Calif. 94114

[21] Appl. No.: 934,506

[22] Filed: Nov. 24, 1986

[51] Int. Cl.[4] ..... B63H 9/08

[52] U.S. Cl. ..... 114/39.2; 114/89; 24/129 R; 24/481

[58] Field of Search ..... 114/39, 39.2, 89, 90, 114/97, 98; 105/354; 24/129 R, 481; 441/69

[56] References Cited

U.S. PATENT DOCUMENTS

| | | | |
|---|---|---|---|
| 1,065,383 | 6/1913 | Miller | 105/354 |
| 4,414,712 | 11/1983 | Beggins | 114/218 |
| 4,418,631 | 12/1983 | Frohbach | 114/97 |

FOREIGN PATENT DOCUMENTS

| | | | |
|---|---|---|---|
| 2738071 | 3/1979 | Fed. Rep. of Germany | 114/98 |
| 2831766 | 1/1980 | Fed. Rep. of Germany | 114/39.2 |
| 8101365 | 10/1982 | Netherlands | 114/39.2 |
| 261212 | 11/1926 | United Kingdom | 105/354 |
| 2140754 | 12/1984 | United Kingdom | 114/97 |

*Primary Examiner*—Joseph F. Peters, Jr.
*Assistant Examiner*—Edwin L. Swinehart
*Attorney, Agent, or Firm*—Limbach, Limbach & Sutton

[57] ABSTRACT

A handgrip extension to be attached to the boom of a sailboard is disclosed. The extension permits the user to confortably grip the forward end of the boom to minimize injury and discomfort while allowing greater control and speed in sailboarding.

8 Claims, 3 Drawing Sheets

SAIL BOARD HANDGRIP

BACKGROUND OF THE INVENTION

Board sailing has developed rapidly over the past several years into an exceedingly popular sport in many countries of the world. While there have been many changes in the configuration of the board, the basic technique is to position the sail for navigation in much the same manner as in a small boat. However, sailboards are so light that positioning the sail to create lift on the sail permits greater speed. The primary lift-creating technique is to "close the gap", which means to pull the mast back to render more acute the angle between the board and the bottom of the sail, while maintaining the sail in the optimum plane for forward motion. Making use of both the lifting vector as well as the forward vector increases speed.

Another major reason for closing the gap is to minimize the flow of air under the sail. Wind should either propel the sail forward or lift it. Wind passing under the sail is "wasted." If there is no spilling of wind under the sail, there is maximum propulsion, called the "end plate effect."

The boardsailor closes the gap by raking back the mast, while maintaining it generally perpendicular to the water, so that the foot of the sail is at or near the top of the board. The forward hand, whether the sailor is on the right or left side of the board, is the one stressed mostly in closing the gap. The stress imposed on the hands and arms causes shoulder strain, epicondylitis, commonly called "tennis elbow", tendinitis in the wrist and hand, and wrist strains by reason of the unaccustomed forward hand position on the boom. That is, the boom is generally horizontal and parallel to the board. The sailor grips the boom with the forward hand either over the boom or under deviating the wrist toward the thumb or little finger side of the hand. Both positions are unnatural and will, in time, lead to the stress-caused problems.

There is a need for a means to naturally grip the boom of a sailboard for long periods of time to ease the stress on the arms of the sailor. The problem is no different from stress encountered in the industrial workplace. As stated in Meagher, "Human Factors Engineering: Primer for Surgeon's Participation in Industrial Injury Prevention" (Contemporary Orthopedics 8:73–80; March 1984), holding the arm horizontally for the performance of work tasks increases muscle fatigue and strain if the moment arm is increased. The forward hand of the sailboard is generally horizontal and at a great moment arm. To ease the fatigue and strain, the hand should meet the wrist in a horizontal plane in the same neutral position that exists when the hand and arm are in a passive, dependent position beside the trunk, with flexors and extensors in balance. Also, Meagher points out, industrial handles should fit the curve of the flexed proximal interphalangeal joints to permit even application of force. That is, gripping a curved handle is less stressful over a long period than gripping a straight handle.

The prior art in sailboards includes a chuck for tightening the sail, but this device is used solely for rigging the sail, and is not used in sailing.

Another previous device is a hook attached to a wrist strap on the wrist which permits the sailor to hook the boom and give his hand a rest. Such devices are actually counter-productive, at least as far as shoulder, elbow, forearm and wrist problems of concern here are involved, because the forces are transmitted directly from the boom to the wrist.

At the present time, there is in widespread use harnesses that the sailor wears and hooks to the boom by means of a harness line. The harness allows the sailor to use his body weight to sheet in the sail, thereby sparing his upper extremities. However, these harnesses are not helpful in resolving the problems addressed in this invention, such as elbow, wrist and hand problems.

The problem of strain on arms and shoulders is addressed in U.S. Pat. No. 4,505,216, which shows an elongated flexible element connected to the mast and adapted to receive the user's body so that the user can lean back on the element to apply weight to the boom without using his hands. However, such a device can only be used under steady state conditions, and any tack or change in conditions requires the user to again grasp the boom. There is a need for a device to permit gripping the boom under all conditions with a minimum of straining on upper extremities.

SUMMARY OF THE INVENTION

The present invention reduces the stress-induced wrist and arm problems by providing an extension for the forward hand to the boom. The extension includes a generally vertical handgrip to allow comfortable, natural grasping, instead of the unnatural over or under grasping of the generally horizontal boom. The extension effectively lengthens the forward arm by about four to ten inches, permitting easier water starts, more speed, maintenance of the mast in a vertical plane relative to the centerline of the board, and less fatigue. The extension is flexible to allow the wrist to move through all planes while gripping the boom.

In its preferred form the handgrip is a slightly curved length of tubing 14 cm long and 1.9 cm in diameter. At each end of the tube elbows are joined. A rope about 83 cm long and 1 cm in diameter passes through the tube and elbows and is attached to the boom by a flexible sling.

DESCRIPTION OF THE PREFERRED EMBODIMENTS

Figure 1:
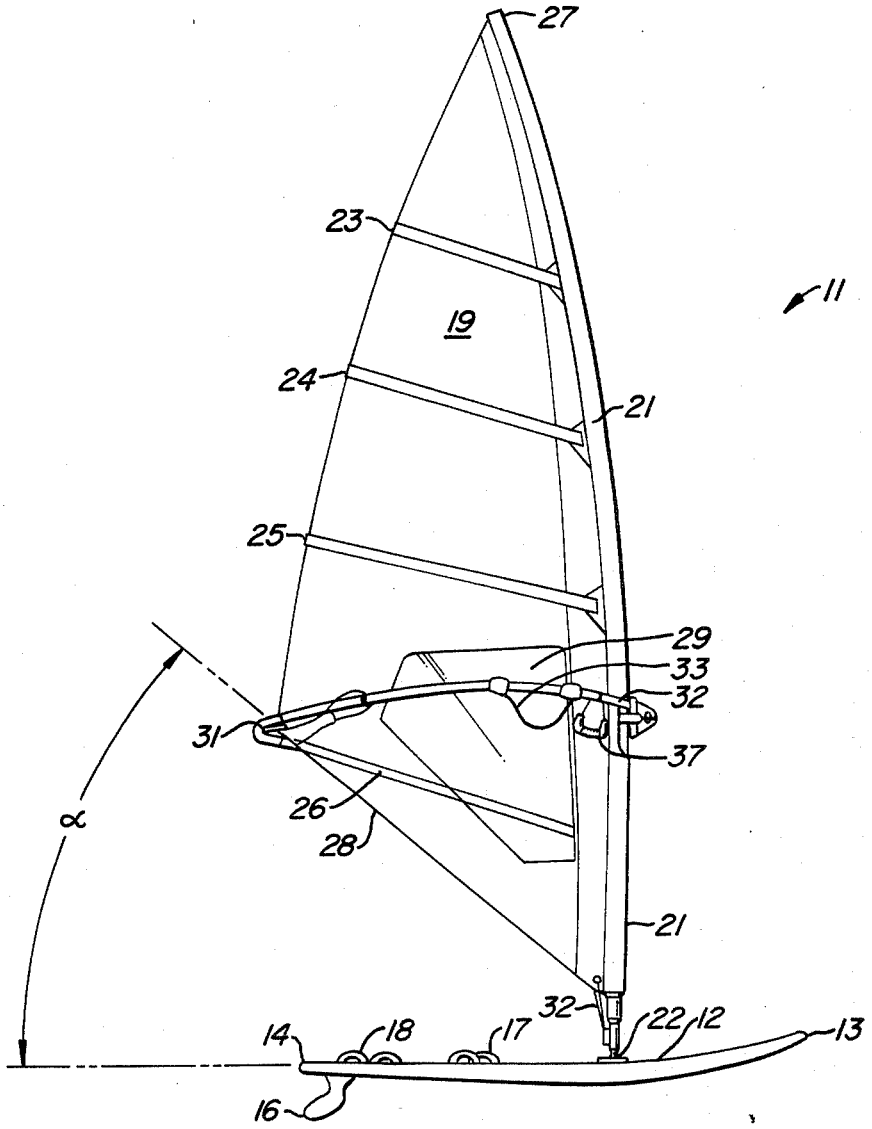
FIG. 1 is a side view of a conventional sailboard.

As shown in FIG. 1, the conventional sailboard 11 include a board 12 with a nose 13 and a tail 14. Board 12 also has a skeg 16 on the bottom and foot straps 17 and 18 on the top. Sail 19 is attached to mast 21, which is secured to board 12 at universal 22. Sail 19 has a series of battens 23, 24, 25 and 26 between head 27 and foot 28. There is also a window 29 in sail 19. The sail 19 is secured at its foot 28 by outhaul purchase 31 and a downhaul purchase 32.

Boom 32 extends from mast 21 to outhaul purchase 32 on either side of sail 19. It has a harness line 33 for allowing the sailor to use his weight in sheeting in the sail of the conventional sailboard.

Figure 2:
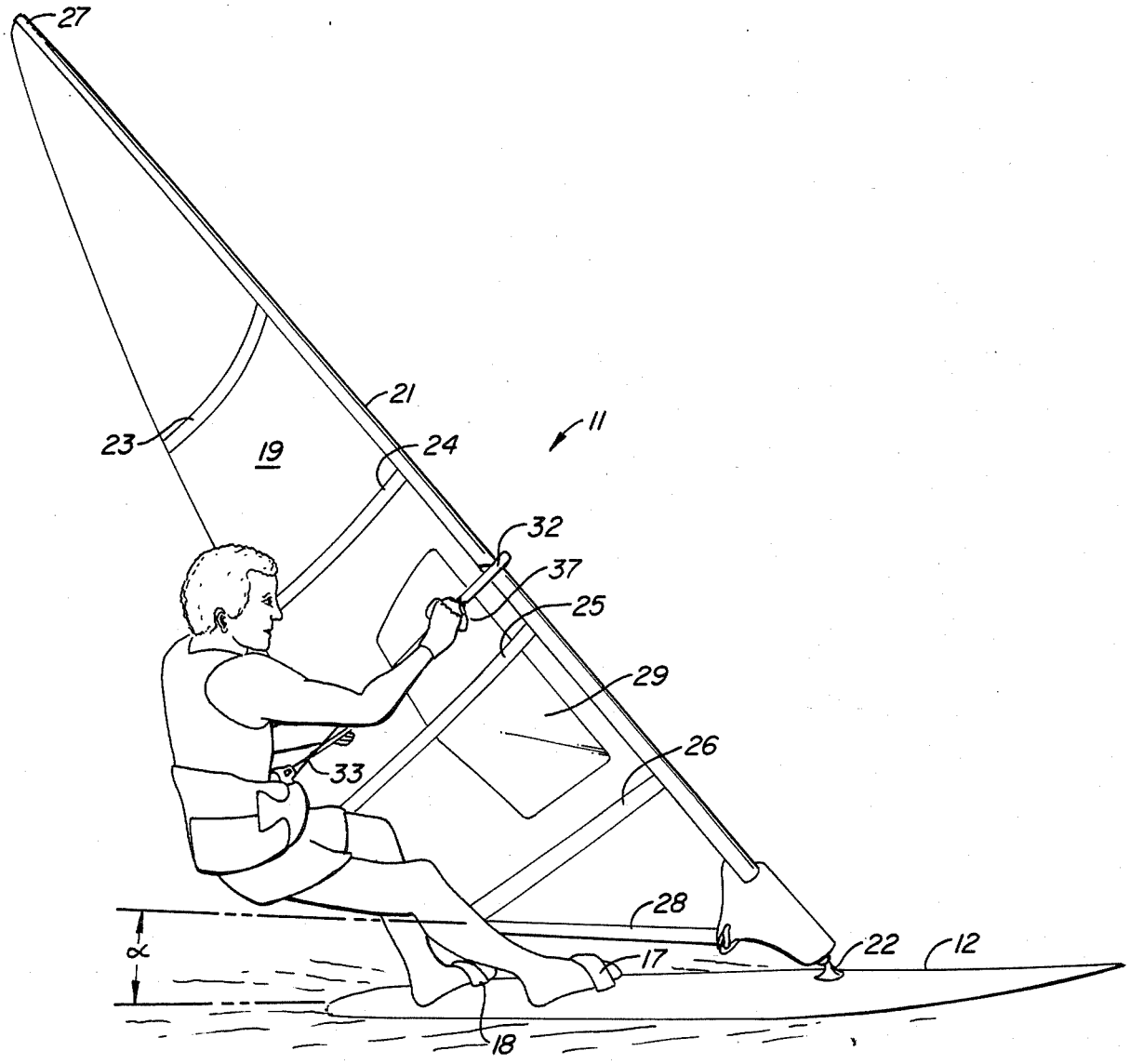
FIG. 2 is a side view of a sailboard in practice with the gap closed and using the extension of this invention.

FIG. 2 is an illustration of a sailor using the extension of this invention in a speed sailing mode. Note that angle e is approaching zero, the mast is raked back, and lift and forward thrust near the maximum. As such, it is the fastest sailing craft in the world, exceeding forty miles per hour.

In conventional operation, sailor 36 places his feet in boot straps 17 and 18, and one hand on the front of boom 32 and one on the back end. According to the present invention, the forward hand grips extension 37 attached to the forward end of boom 32, rather than the boom itself. Conventional direct gripping of boom may also be used, if desired. Extension 37 permits the hand to meet the wrist in a horizontal plane when the mast 21 is perpendicular to the water in a neutral position, with flexors and extensors in balance. It is a much more natural position than conventional grasping of the boom with the forward hand, where either flexors (overhand) are strained or the extensors (underhand) are strained. Extension 37 is generally parallel to the mast, whereas the boom is generally perpendicular to the mast. Extension 37 may be rotated through any plane that the wrist allows. Gripping area 38 should be long enough to comfortably fit the forward hand of the sailor. Generally, 14 cm is a sufficient length, but it may be longer or shorter.

As shown in FIG. 2, extension 37 includes a gripping area 38 which is conveniently slightly curved conduit of ¾" (19 mm) ID polyvinyl chloride conduit. Any light weight material may be used for the gripping area, and the diameter and grip curvature should be suitable for the hand of the sailor. Children may find ½ inch diameter tubing better, and those with large hands may prefer a diameter as large as 1¼ inch. The slight curve allows a much stronger pull on the forward hand than is possible gripping the boom itself and naturally fits the curve of the flexed finger joints to permit even application of force.

In practice, gripping area 38 can be conveniently formed to approximate the arc of interphalangeal joints by simply bending the conduit at an angle of 5° to 15° from straight conduit at about the midpoint of gripping area 38.

The forward hand has the greater stress, both in normal sailing and in speed sailing. Speed sailing is facilitated by "closing the gap", which is the angle $\alpha$ (FIG. 1) between the foot 28 of sail 19 and the board plane 39. By pulling back on the boom, mast 21 moves rearwardly and angle $\alpha$ decreases, and the board 11 goes faster.

Speed is affected by many factors, not just angle $\alpha$. The angle of attack of the sail should be within the "performance envelope" ("Wind Surf" magazine, November, 1986, p. 50) of 3° to 9° from the direction of the board. That is, the skating angle must relate to wind velocity. Also, the mast should generally be in a plane perpendicular to the water to maximize the amount of wind caught by the sail.

FIG. 2 also shows gripping area 38 with a soft covering adhered to it. A suitable cover is the same plastic foam used for boom wrap. I have found boom wrap 2.5 mm in thickness made by Astrodeck, Inc., P. O. Box 4296, San Clemente, CA 92672 to be suitable. Gripping area 38 is joined at either end by end pieces 41 and 42. If PVC conduit is used for gripping area 38, it may be simply glued into PVC elbows 41 and 42. Other configurations and materials may be used, but elbows 41 and 42 are readily available. Preferably, elbows 41 and 42 taper toward rope 43 to reduce wind drag. If desired, a single hollow extrusion incorporation gripping area 38 and elbows 41 and 42 may be used. Nylon rope 43 inserted into hollow parts 38, 41 and 42 connects the handgrip to sling 44. Sling 44, in the embodiment shown in FIG. 2, is nylon cloth sewn to provide four tunnels to accommodate rope 43. Rope 43 is conveniently ⅜ inch (1 cm) about 33 inches (83 cm) long. Sling 44, in the embodiment shown, is 1⅞ inch (4.8 cm) times 4 inches (10 cm), sewn with three lines of stitching 46, 47 and 48. Sufficient frictional force to secure the extension 37 to boom 32 is accomplished by passing one end 49 of rope 43 through first tunnel 51, around the boom (not shown) and into third tunnel 52. The other end 50 of rope 43 goes first through outboard tunnel 53, around the boom (not shown), and thence into tunnel 54. It is preferred to cross the ends of the rope as they pass around the boom for additional friction and less slippage. Of course, any rigging desired may be used, so long as frictional contact is great enough to hold extension 37 securely to the boom 32.

Figure 3:
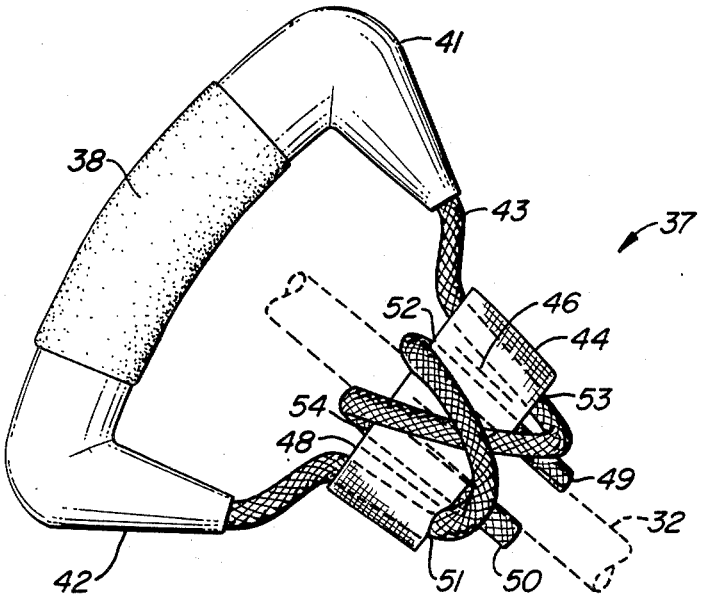
FIG. 3 is a plan view of the handgrip extension with a four tunnel sling.
Figure 4:
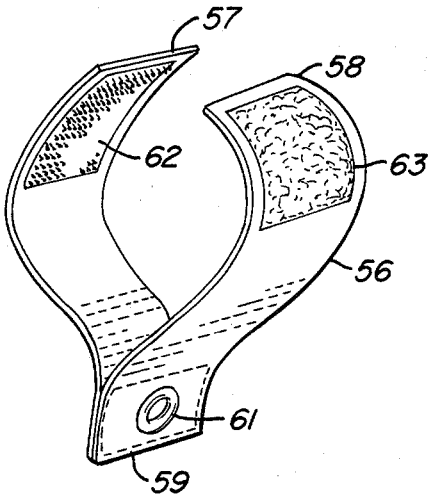
FIG. 4 is a plan view of a velcro boom binder.

An alternative embodiment for attaching the extension 37 to boom 32 is shown in FIG. 4. Boom binder 56 consists of two strips 57 and 58 of nylon the approximately 2 inches wide and 7 inches long. The two strips are joined at one end and sewn together at 59. The stitching 59 also encircles grommet 61, which has an inside diameter sufficient to permit passage of both ends 49 and 50 of rope 43. The ends are knotted (not shown) to secure rope 43 to boom binder 56. The other ends of strips 57 and 58 carry the two parts of a multiple plastic hook and eye attachment sold in the trade as Velcro are free having hooks 62 and the other free having eyes 63. Hooks 62 are sewn to one face of strip 57 and eyes 63 are sewn to the opposite face of strip 58. In practice, the extension may be simply wrapped around the boom, hooks 62 joined to eyes 63, and the rope 43 (FIG. 3) secured at grommet 61 (FIG. 4).

Any common expedient for flexibly joining the gripping area to the boom may be used, such as C-clamps (not shown), a universal (not shown), or even simply knotting the rope 43 to the boom 32.

Figure 5:
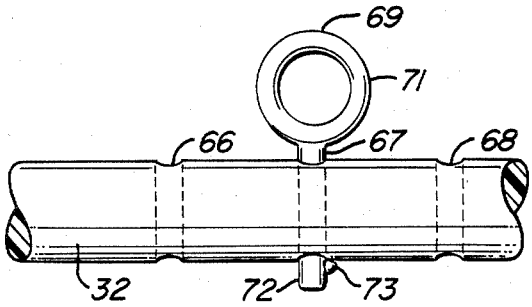
FIG. 5 is a side view of another variation of the extension.

FIG. 5 shows a convenient means for adjusting the extension to the boom for accommodating different sizes of sailors, different wind conditions, and the desired manner of sailing. Boom 32 is constructed with vertical holes 66, 67 and 68 drilled through to accommodate a pin. Pin 69 has a ring 71 through which the two ends 50 and 49 of rope 43 (FIG. 3) may be knotted to secure extension 37 to boom 32. Ring 71 is secured to shaft 72 as by welding, brazing or forging. At the distal end of shaft 72, pin 69 has a detent 73 which is spring-urged (not shown) to keep pin 69 in hole 67.

It will be apparent that the extension of this invention provides a much more comfortable grip for sailboarding, easing stress on the shoulders, arms and wrist of sailors.

I claim:

1. A handgrip extension adapted to be removeably attached to the forward end of the boom of a sailboard, said extension comprising a generally tubular gripping area for grasping by the hand of the user across the palm and with thumb and fingers opposed and encircling the gripping area, end pieces at each end of the gripping area, and attachment means for rotatably affixing the extension to the boom in a manner allowing 360° rotation of the forward gripping hand.

2. An apparatus as in claim 1 wherein the gripping area is covered with a soft, flexible surface to enhance the comfort to the hand of the user.

3. An apparatus as in claim 1 wherein said end pieces are elbows with one side joined to the gripping area and the other side directed towards the boom when in use.

4. An apparatus as in claim 1 wherein said attachment means is a length of nylon rope extending through the tubular gripping area and end pieces and having its ends bound in a boom binder.

5. An apparatus as in claim 4 wherein the boom binder is a strap with plastic hooks adhered to one face of the strap and plastic eyes adhered to the opposite face of the strap, whereby the strap may be wrapped around the boom and attached to itself with the hooks and eyes.

6. An apparatus as in claim 4 wherein the boom binder is a pin with a ring accommodating the two ends of the rope to permit knotting the rope to the ring, and a shaft on the pin adapted to fit in one of several holes in the boom, whereby the location of the extension on the boom may be adjusted.

7. A handgrip extension adapted to be removeably attached to the forward end of the boom of a sailboard, said extension comprising a generally tubular gripping area for grasping by the hand of the user across the palm and with thumb and fingers opposed and encircling the gripping area, end pieces at each end of the gripping area, and attachment means for rotatably affixing the extension to the boom in a manner allowing 360° rotation of the gripping hand, said attachment means comprising a length of rope extending through the tubular gripping area to a boom binder having four tunnels, each tunnel providing friction between the rope and the tunnel, whereby each end of the rope is passed through one pair of tunnels in the direction from the extension gripping area toward the boom, encircles the boom tightly, and is lodged in the other pair of tunnels.

8. In a sailboard comprising a board, a sail and a boom, the improvement comprising a handgrip extension attached to the forward end of the boom, said extension being rotatably mounted to allow 360° rotation of the forward hand, said handgrip extension comprises a gripping surface, a boom binder, and means connecting the gripping surface to the boom binder.

* * * * *